US007121750B2

(12) United States Patent
Iwase et al.

(10) Patent No.: US 7,121,750 B2
(45) Date of Patent: Oct. 17, 2006

(54) INKJET PRINTER WITH CUTTING HEAD HAVING SMOOTHLY MOVABLE HEADS

(75) Inventors: Fumiyoshi Iwase, Hamamatsu (JP); Yuichi Sugiyama, Hamamatsu (JP); Yuji Sakata, Shizuoka-ken (JP)

(73) Assignee: Roland DG Corporation, Shizuoka-Ken (JP)

( * ) Notice: Subject to any disclaimer, the term of this patent is extended or adjusted under 35 U.S.C. 154(b) by 23 days.

(21) Appl. No.: 10/859,401

(22) Filed: Jun. 2, 2004

(65) Prior Publication Data

US 2005/0270352 A1 Dec. 8, 2005

(51) Int. Cl.
*B41J 19/18* (2006.01)
*B41J 11/66* (2006.01)
*B41J 2/01* (2006.01)

(52) U.S. Cl. ..... 400/354; 400/621; 400/352; 347/37

(58) Field of Classification Search ..... None
See application file for complete search history.

(56) References Cited

U.S. PATENT DOCUMENTS 4,566,814 A * 1/1986 Papp et al. ..... 400/354.1
5,363,123 A * 11/1994 Petersen et al. ..... 346/24
5,381,168 A * 1/1995 Kondo et al. ..... 347/30
6,908,243 B1 * 6/2005 Lai ..... 400/621

FOREIGN PATENT DOCUMENTS

GB 2295584 A * 6/1996
JP 9254591 9/1997
JP 11138848 A * 5/1999
JP 11151896 A * 6/1999
JP 3645012 B2 5/2005

OTHER PUBLICATIONS

Machine translation of JP 11-138848 to Miyazawa et al. from Japanese Patent Office website.*

* cited by examiner

*Primary Examiner*—Daniel J. Colilla
(74) *Attorney, Agent, or Firm*—Ditthavong & Mori, P.C.

(57) ABSTRACT

An inkjet printer with a cutting head comprises a linear motion rail, and a linear motion block slidably provided on the linear motion rail. An inkjet head carriage holding an inkjet head and a cutting head carriage holding a cutting head are fixed to the linear motion block through respective mounting parts and moved along the linear motion rail.

8 Claims, 9 Drawing Sheets

INKJET PRINTER WITH CUTTING HEAD HAVING SMOOTHLY MOVABLE HEADS

BACKGROUND OF THE INVENTION

1. Field of the Invention

The present invention relates to an inkjet printer with a cutting head which can form an image and cut out the image and more particularly, it relates to an inkjet printer with a cutting head which can form an image and cut out the image with high precision.

2. Description of the Background Art

An inkjet printer with a cutting head is well-known in the art, which is operated by computer control so as to cut an image such as a character, a drawing or a sign from a sheet such as paper or a marking film based on image data output from a host computer.

The conventional inkjet printer with a cutting head has been disclosed in Japanese Unexamined Patent Publication No. 9-254591, for example. According to the above document, the inkjet printer with the cutting head comprises a pen block having an elevating mechanism for pressing or separating a recording pen or a cutting pen held therein, toward or from a recorded medium, a moving mechanism for moving the pen block, and an inkjet block having an inkjet head. When the image is formed by the inkjet head, the inkjet block is connected to the pen block by the pen block moving mechanism and the image is formed by the inkjet head through the movement of the pen block, and the inkjet block is separated from the pen block by operating the elevating mechanism of the pen block.

In order to connect the pen block to the inkjet block, a hook mounted on a slider of the pen block, a lever member mounted on the inkjet block so as to be rotated around a shaft, a torsion coil spring constantly forcing the lever member in a predetermined direction, a stopper, an abutting member and the like are used, and the constitution becomes complicate.

The conventional inkjet printer with the cutting head was constituted as described above. There are problems that a connection structure between the pen block and the inkjet head bock is complicated, the pen block and the inkjet block are not likely to be smoothly moved although they are slidably mounted on the same rail through a slider. Furthermore, there is deviation between the inject head and the capping position at an end of the inkjet head in which a capping operation or the like is performed, so that the capping operation cannot be performed with high precision.

SUMMARY OF THE INVENTION

It is an object of the present invention to provide an inkjet printer with a cutting head in which a connection structure between a cutting head and an inkjet head is simple.

It is another object of the present invention to provide an inkjet printer with a cutting head in which a cutting head and an inkjet head can be smoothly moved on a rail.

It is still another object of the present invention to provide an inkjet printer with a cutting head in which a constitution can be simplified and costs can be reduced.

An inkjet printer with a cutting head according to the present invention comprises a linear motion rail and a linear motion block slidably provided on the linear motion rail, in which an inkjet head and the cutting head are fixed to the linear motion block.

Since the inkjet head and the cutting head are fixed to the linear motion block and moved along the linear motion rail, the inkjet head and the cutting head are smoothly moved.

Preferably, an inkjet printer with a cutting head for forming a desired image and cutting the image based on image data comprises a moving part for moving a sheet in the X direction, a cutting head supported so as to be movable in the Y direction along a linear motion guide on a guide rail provided so as to be extended in the Y direction vertical to the X direction in which the sheet is moved by the moving part and comprising a cutter for cutting the sheet based on the desired image, an inkjet head supported so as to be movable in the Y direction along the linear motion guide, provided so as to be positioned on the side of the cutting head in the Y direction, and forming the desired image on the sheet, a controller for controlling the movement of the cutting head and the inkjet head in the Y direction along the linear motion guide based on the image data, a first connection part provided in the cutting head on the side of the inkjet head in the Y direction, for detachably connecting the inkjet head to the cutting head, a second connection part provided in the inkjet head on the side of the cutting head in the Y direction so as to be connected to the first connection part, for detachably connecting the cutting head to the inkjet head, and a locking part provided in the inkjet head on the opposite side of the cutting head in the Y direction, for detachably locking the inkjet head to a fixing member of the inkjet printer with the cutting head. When the image is formed based on the image data, the inkjet head is separated from the fixing member of the inkjet printer with the cutting head by the locking part, the first connection part and the second connection part are connected to connect the cutting head and the inkjet head, and the inkjet head and the cutting head are integrally moved along the linear motion guide in the Y direction by the controller based on the image data to form the desired image on the sheet. When the image is cut based on the image data, the inkjet head is locked to the fixing member of the inkjet printer with the cutting head by the locking part, the first connection part is separated from the second connection part to separate the inkjet head from the cutting head, and only the cutting head is moved along the linear motion guide in the Y direction by the controller based on the image data to cut the sheet based on the desired image.

Still preferably, both or any one of the first connection part and the second connection part comprise a magnet. Since the first and the second connection parts comprise the magnets, there can be provided the inkjet printer with the cutting head having the simple connection structure.

The first connection part and the second connection part may comprise a solenoid with a plunger and an engagement hole, respectively.

Still preferably, the cutting head comprises a solenoid for driving the cutter and the solenoid operates as the first and the second connection parts. Since the solenoid serves as both driving the cutter and connecting parts, costs can be reduced.

Still preferably, the locking part is unlocked from a state in which the locking part of the inkjet head engages with the fixing member by moving the cutting head and the inkjet head in the direction opposite to the fixing member.

Still further, the magnet connection is separated by moving the cutting head in the direction opposite to the fixing member in a state the inkjet head is locked to the fixing member by the locking part and the inkjet head and the cutting head are connected by the magnet.

Still further, a positioning part for positioning the inkjet nozzle of the inkjet head at the capping position is further comprised at the driving part side end.

Still further, an engaging body mounting member provided at one end of the guide rail for positioning a nozzle of the inkjet head at the capping position is further comprised, and the engaging body mounting member is constituted by a single member.

Since the engaging body mounting member for positioning the nozzle of the inkjet head at the capping position is constituted one single member, tolerance is not accumulated and there is less distortion. As a result, the capping operation of the inkjet head can be implemented with high precision by a simple constitution.

DESCRIPTION OF THE PREFERRED EMBODIMENTS

One embodiment of the present invention is described with reference to the drawings hereinafter.

Figure 1:
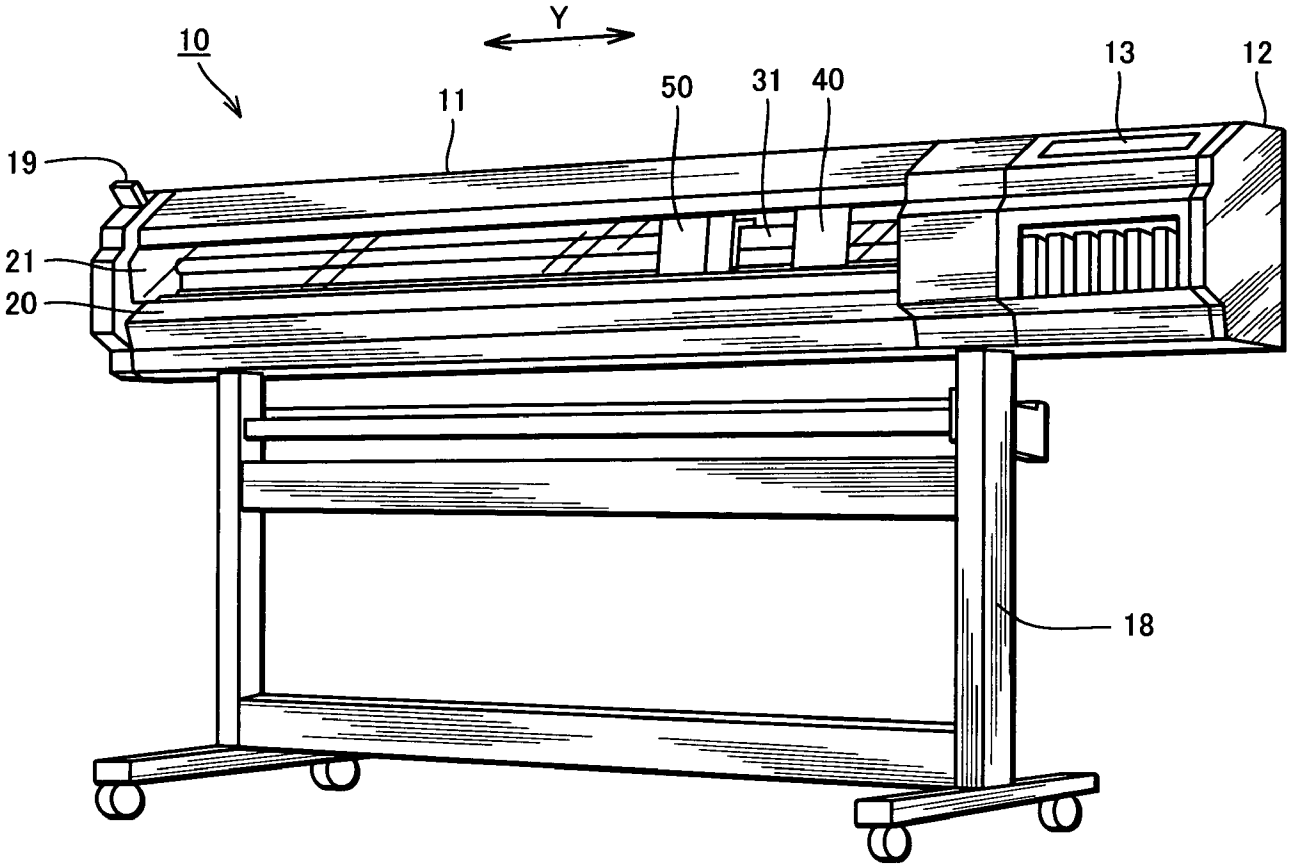
FIG. 1 is a view showing an outer appearance of an inkjet printer with a cutting head according to one embodiment of the present invention.

FIG. 1 is a schematic view showing a whole constitution of an inkjet printer with a cutting head according to one embodiment of the present invention.

An inkjet printer 10 with a cutting head prints a desired image on a sheet and cuts it with a cutter provided in the cutting head by indication from a personal computer and the like as will be described in detail below. Referring to FIG. 1, the inkjet printer 10 with the cutting head comprises a body 11 and legs 18 for supporting the body 11. The body 11 comprises an inkjet head 40 which ejects ink for printing, a cutting head 50 having a cutter, a linear motion rail 31 serving as a guide when the inkjet head 40 is moved in the sub-scanning direction of the lateral direction in the figure, an operation panel 13 provided on one end of the body 11, and side covers 12 provided on both ends of the body 11.

The operation panel 13 comprises a display part for displaying an operation state, a cursor key for designating positions of the inkjet head 40 and the cutting head 50, a start region setting key for designating a region of a predetermined portion to start printing or cutting of the image based on a signal of image data, an operation starting key for staring the printing or the cutting of the image from the set start region and the like.

A front cover 21 is provided at the front of the body 11, and a platen 20 is provided at a lower part of the inkjet head 40 and the cutting head 50 of the body 11. At the left end of the body 11 there is provided a pinch roll lever 19 for pinching a sheet (not shown) over the platen 20 with a pinch roll (not shown) at the time of printing by the inkjet head 40 and cutting by the cutting head 50.

Next, a description is made of the inkjet head 40 and the cutting head 50. FIG. 2 is a front view showing the inkjet head 40 and the cutting head 50. Referring to FIG. 2, the inkjet head 40 is held in an inkjet head carriage 42, and the cutting head 50 is held in a cutting head carriage 49. The inkjet head carriage 42 and the cutting head carriage 49 are connected to each other and driven by a motor 26 through a wire 27 along the linear motion rail 31 in the sub-scanning direction (lateral direction, Y direction in the drawing). Meanwhile, the sheet to be printed is driven in the scanning direction (direction toward the paper, X direction) which intersects the sub-scanning direction at right angles while pressed by a pinch roller (not shown).

The inkjet head 40 has inkjet nozzles 41 for jetting ink such as yellow (Y), magenta (M), cyan (C) and black (K), respectively.

The cutting head 50 has a cutter holder 29 and a cutter 51 is held at a predetermined position by the cutter holder 29. The cutter 51 is usually in a state it is drawn upward by a coil spring (not shown). When the sheet and the like is cut with the cutter 51, a solenoid 52 provided in the cutting head 50 is operated to lower the cutter 51 to a cutting surface by a plunger 58 against the coil spring.

In addition, the cutter 51 is mounted on a predetermined mounting part and there are a swivel knife system or a rotary system in the mounting part in which any cutter such as an ultrasonic disc cutter, a heat cutter and the like as well as a normal cutter can be mounted.

In addition, at the mounting part, the cutter holder may be replaced with a pen holder for holding a pen for drawing an image such as an ink pen, a felt pen, a ballpoint pen, or a pencil by which the image can be formed on the basis of the image data.

Figure 2A:
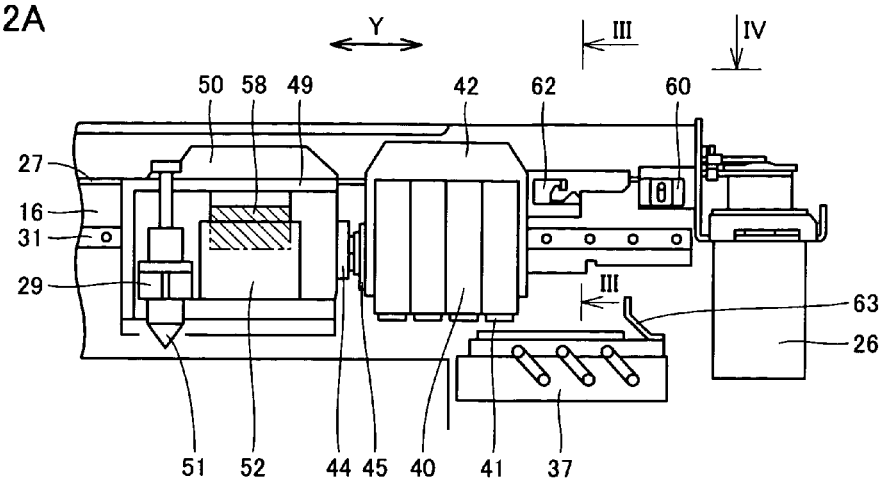
FIGS. 2A to 2C are front views and a plan view showing a connection state between a cutting head carriage and an inkjet head carriage.

Then, a description is made of a connection part between the inkjet head carriage 42 and the cutting head carriage 49. FIG. 2A is a view showing the connection part between the inkjet head carriage 42 and the cutting head carriage 49 and shows a state before the inkjet head carriage 42 reaches a capping device 37 for capping the nozzles of the inkjet head 40.

Referring to FIG. 2A, the inkjet head carriage 42 is provided so as to be positioned on the right side of the cutting head carriage 49 on the linear motion rail 31. Both can be appropriately attached or detached by a magnet 45 fixed to the left side wall of the inkjet head carriage 42 and a magnet 44 fixed to the right side wall of the cutting head carriage 49. These magnets 44 and 45 correspond to a first connection part and a second connection part, respectively. In addition, instead of using two magnets for connecting both, one of them may be the magnet and the other may be an iron plate or the like.

As described above, according to this embodiment, the inkjet head carriage 42 and the cutting head carriage 49 are connected or disconnected by connecting the magnets 44 and 45 or not.

In addition, the cutting head carriage 49 is driven by the wire 27 and the inkjet head carriage 42 is driven so as to follow the cutting head carriage 49, as will be described in detail below.

Figure 2B:
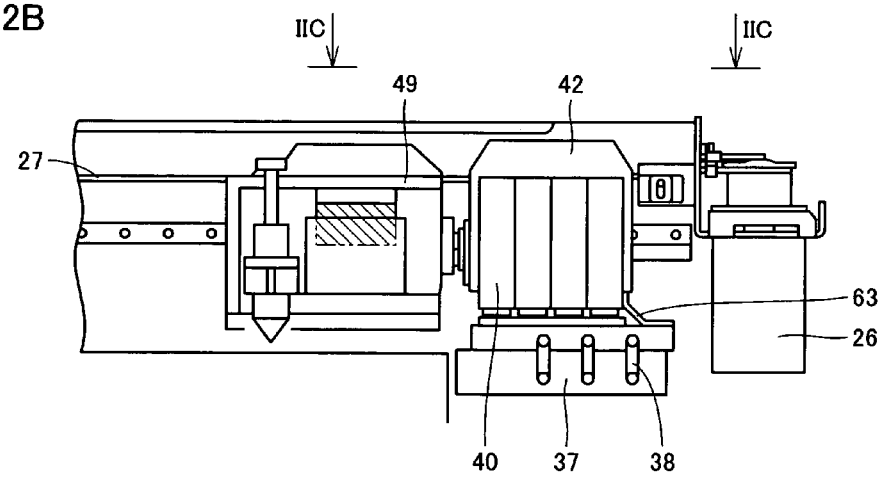
Figure 2C:
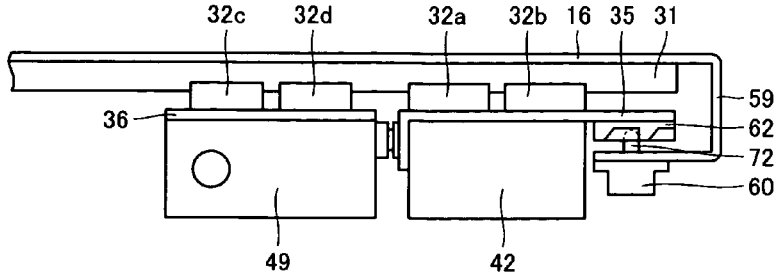

Then, a description is made of a state in which the nozzles of the inkjet head 40 engage with the capping device 37 at a capping position. FIG. 2B shows this state. The inkjet head carriage 42 is moved to the right end by the cutting head carriage 49, whereby the right end of the inkjet head carriage 42 abuts on a stopper 63 mounted on the right end of the capping device 37. When the inkjet head carriage 42 reaches this position, fittings 38 turnably mounted on the capping device 37 rise upward in the vertical direction, and the nozzles 41 of the inkjet head 40 are capped. FIG. 2C is a plan view showing a part taken in the direction of the arrows substantially along the line IIC—IIC of FIG. 2B. Referring to FIG. 2C, the inkjet head carriage 42 is mounted on an inkjet head mounting part 35 and mounted on the linear motion rail 31 through two linear motion blocks 32*a* and 32*b*. Similarly, the cutting head carriage 49 is mounted on a cutting head mounting part 36 and mounted on the linear motion rail 31 through two linear motion blocks 32*c* and 32*d*.

Figure 3A:
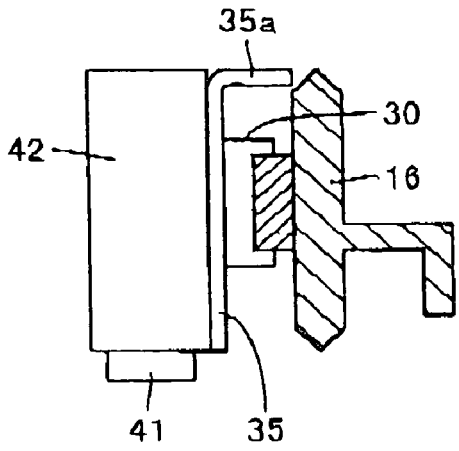
FIGS. 3A and 3B are views showing a linear motion guide.
Figure 3B:
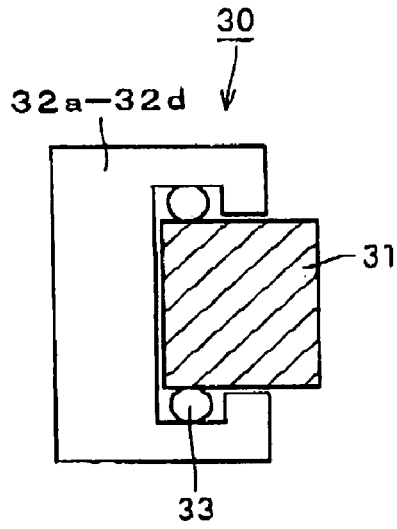

Then, a description is made of a linear motion guide 30. FIG. 3A is a sectional view showing a part taken in the direction of the arrows substantially along the line III—III of FIG. 2A, and FIG. 3B is a view showing the linear motion guide 30 in detail. Referring to FIGS. 3A and 3B, the linear motion guide 30 is mounted on a guide rail 16. The linear motion guide 30 comprises the linear motion rail 31 and linear motion blocks 32*a*–32*d* moving along the linear motion rail 31 in a sliding manner. As described above, the inkjet head mounting part 35 and the cutting head mounting part 36 are mounted on the linear motion blocks 32*a*–32*d*. As shown in FIG. 3B, there is provided a groove in the linear motion blocks 32*a*–32*d* in which a plurality of balls 33 can be rolled between the linear motion rail 31 and the linear motion blocks 32*a*–32*d* along the linear motion rail 31, so that the linear motion blocks 32*a*–32*d* can be smoothly moved on the linear motion rail 31. Here, the plurality of balls 33 rotate in the linear motion blocks 32*a*–32*d*.

Figure 4A:
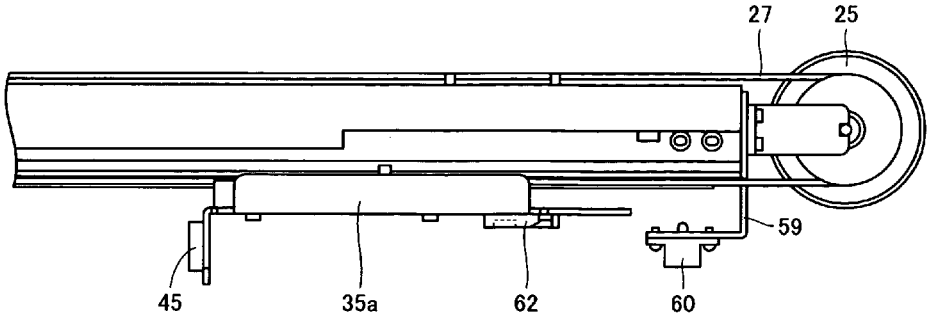
FIGS. 4A to 4C are plan views and a front view showing a driving part side end of the inkjet printer with the cutting head in detail.
Figure 4B:
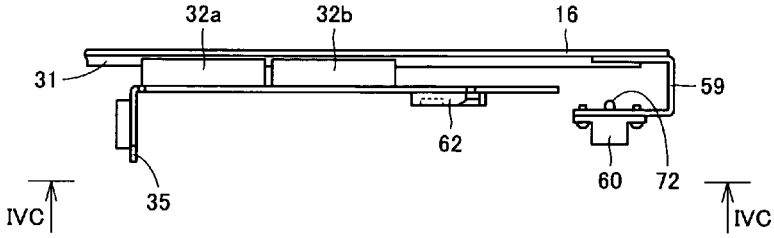
Figure 4C:
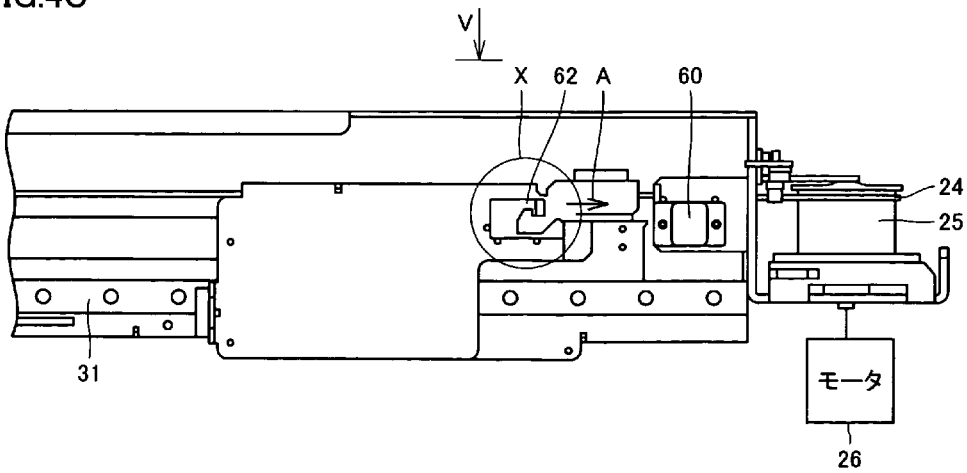

Next, a description is made of a state in which the inkjet head 40 is mounted. FIG. 4A is a plan view showing the inkjet head mounting part 35 for mounting the inkjet head 40 taken in the direction of the arrow substantially along the line IV of FIG. 2A. FIG. 4B is a view showing a state in which a cover 35*a* of the head mounting part 35 for covering the linear motion guide 30 is excluded from FIG. 4A, and FIG. 4C is a view taken in the direction of the arrows substantially along the line IVC—IVC of FIG. 4B. FIG. 4C corresponds to FIG. 2A except that the inkjet head carriage 42 is dismounted. In addition, In FIG. 4B, a pulley 25 provided at an end for moving the linear motion block 32 or the like is omitted. As shown in FIG. 4B, the inkjet head 40 is mounted on the inkjet head mounting part 35 by the linear motion blocks 32*a* and 32*b*.

In addition, similar to the inkjet head carriage 42, the cutting head carriage 49 is mounted on the linear motion guide using the cutting head mounting part similar to the inkjet head mounting part 35 but they are omitted in FIGS. 4A to 4C.

Referring to FIG. 4A, the pulley 25 connected to the motor 26 (FIG. 4C) is provided at a driving side end of the inkjet printer 10 with the cutting head. The wire 27 wound around the pulley 25 is driven when the pulley 25 is driven by the motor 26. As described above, the wire 27 is connected to the cutting head carriage 49 (not shown) so that the inkjet head carriage 42 connected to the cutting head carriage 49 by the magnet 45 is moved in the sub-scanning direction.

Referring to FIG. 4B, a reversed C-shaped engaging body mounting member 59 is mounted on the end of the driving part of the guide rail 16. Thus, since the engaging body mounting member 59 for fixing the inkjet head 40 to the end is constituted by one member mounted on the guide rail 16, tolerance is not accumulated and there is less distortion. As a result, the inkjet head can be capped with high precision by a simple constitution.

Next, a description is made of procedures of fixing the inkjet head 40 to the capping position of the inkjet nozzles. An engaged body 62 is mounted on the inkjet head mounting part 35. In addition, the above engaging body mounting member 59 is mounted on the driving side end of the inkjet printer 10 with the cutting head. FIG. 4B is a plan view showing a state before the inkjet head 40 reaches the capping position as shown in FIG. 2A, and from that state the engaged body 62 mounted on the inkjet head mounting part 35 is moved in the direction shown by the arrow A in FIG. 4C. A plan view showing a state in which the inkjet head 40 reaches the capping position is as shown in FIG. 2C. Referring to FIGS. 4B and 2C, when the inkjet head 40 reaches the capping position, an engaging body 60 mounted on the engaging body mounting member 59 engages with the engaged body 62 mounted on the inkjet head mounting part 35.

Figure 5:
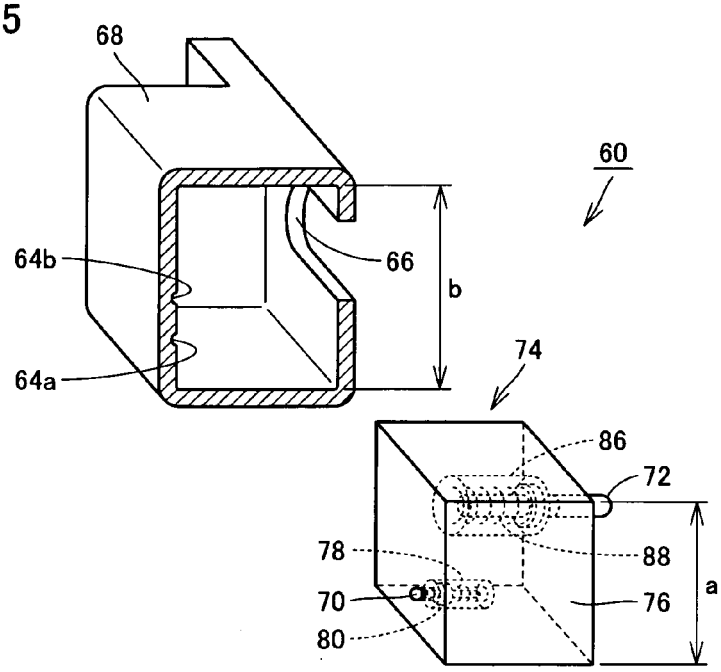
FIGS. 5 to 7 are views showing an engaging body.
Figure 6:
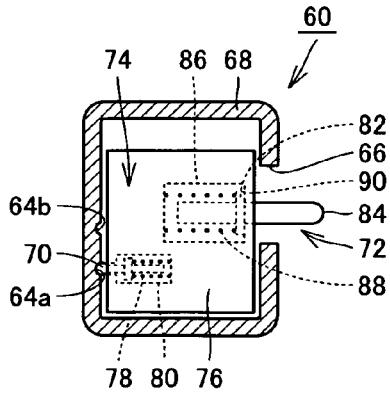
Figure 7:
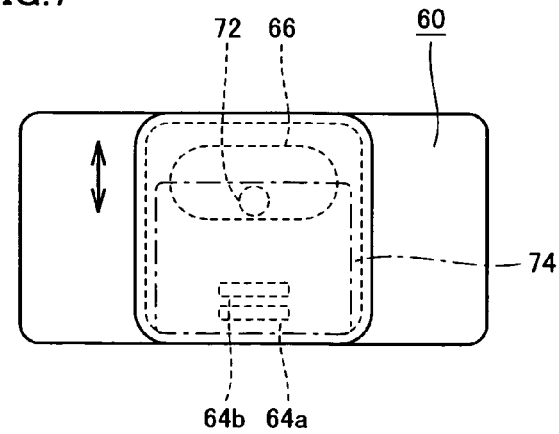
Figure 8:
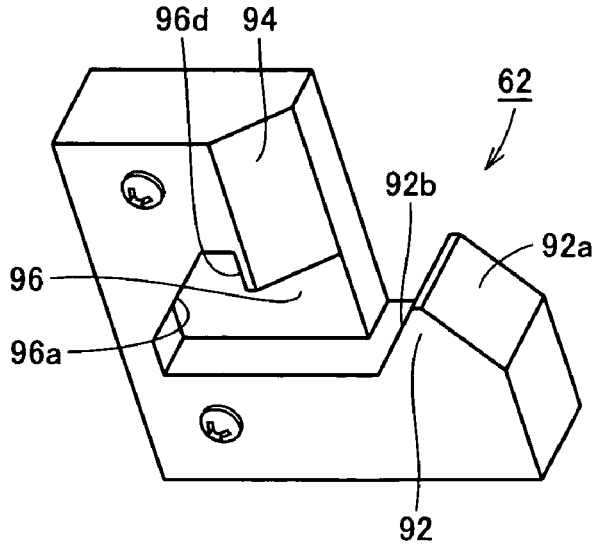
FIG. 8 is a view showing an engaged body.
Figure 9:
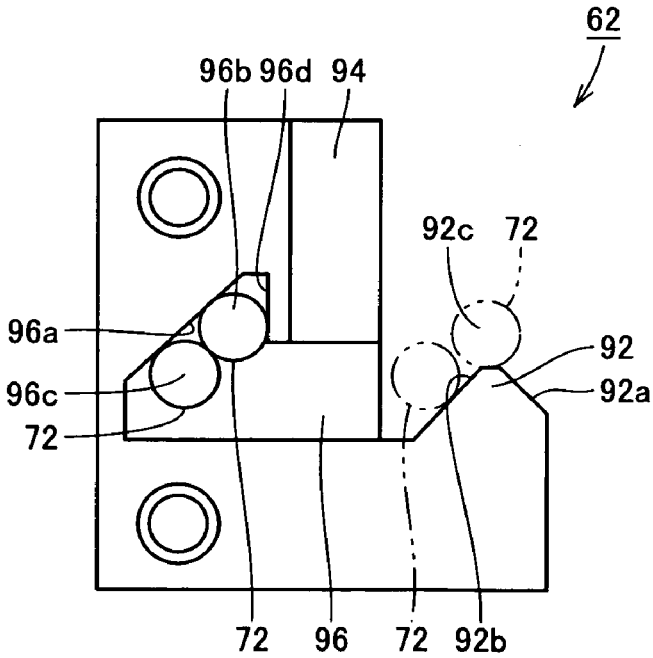
FIG. 9 is a view showing movement of a pin on the engaged body.

Next, a description is made of the engaging body 60 and the engaged body 62. FIGS. 5, 6 and 7 show the engaging body 60 and FIGS. 8 and 9 show the engaged body 62. FIG. 5 is a perspective view showing a resin case 68 constituting the engaging body 60, and a slider 74 movably held therein, separately. FIG. 6 is a view showing a state both are integrated. Referring to FIG. 5, the engaging body 60 is partially omitted as can be easily understood. In addition, the back-and-forth direction in the perspective view in FIG. 5 corresponds to the lateral direction of the engaging body 60 in FIGS. 4A to 4C. Therefore, although a pin 72 projects in the right direction in FIGS. 5 and 6, it actually protrudes in the upward direction in the plan view of the inkjet printer 10 with the cutting head as shown in FIG. 4A or 4B.

As shown in FIGS. 5 and 6, according to the engaging body 60, the slider 74 comprises a metal ball 70 and the pin 72 and fits in the resin case 68. The metal ball 70 can engage with either one of two grooves 64*a* and 64*b* provided in the left end surface in the inner surface of the case 68 so as to be parallel to each other with a predetermined distance above notched part 66. The pin 72 can be moved in a notched part 66 provided in the right end surface of the case 68. In other words, the slider 74 is designed in such a manner that a height "a" is smaller than a height "b" of the case 68 by at least the distance between the grooves 64*a* and 64*b* or more so that it can be vertically moved in the case 68.

FIG. 7 is a top view showing the case 68 in this state (shown in FIG. 4C). Referring to FIG. 7, the slider 74 (shown by one-dotted line in the figure) can be moved in the direction of an arrow in the figure, depending on the engagement state between the two grooves 64*a* and 64*b* and the metal ball 70 so that the pin 72 projects from the notched part 66 toward the guide rail 16 (the backward direction in FIG. 7) and its end is moved on the engaged body 62 as shown in FIG. 9 as will be described below. In addition, although the projecting direction of the pin 72 is in the right direction in FIGS. 5 and 6, it actually projects downward from the upper side of the case 68 as described above (backward from the front side in FIG. 7, that is, the opposite direction of the X direction in which the sheet is conveyed).

In FIGS. 5 and 6, the metal ball 70 is mounted so as to project from a hole 78 provided in the left end surface of a resin slider body 76, through an extension spring 80 so that it is always forced to the left side. As shown in FIG. 6, when the slider 74 is positioned on the lower side in the case 68, the metal ball 70 engages with the lower groove 64*a* and when the slider 74 is positioned on the upper side in the case 68, the metal ball 70 engages with the upper groove 64*b*.

The pin 72 is formed in such a manner that a left end 82 has a diameter larger than its body and a right end 84 is formed spherically. The left end 82 is provided at the right end of the extension spring 88 provided in a hole 86 provided in the right side surface of the resin slider body 76. In the state the pin 72 is inserted, a cylindrical stopper ring 90 is mounted in the hole 86 so as to be on the same surface of the right side surface of the resin slider body 76, and the pin 72 is set so as to be freely moved in the right and left directions without leaving from the right end.

As shown in FIGS. 2C and 4B, the engaging body 60 constituted as described above is mounted on the engaging body mounting member 59 so that the pin 72 may project toward the guide rail 16.

The engaged body 62 is formed by cutting or shaping an almost square-shaped resin flat plate as shown in FIGS. 8 and 9. FIG. 8 is a perspective view and FIG. 9 is an enlarged view showing the engaged body 62 shown in FIG. 4C.

Referring to FIG. 9, according to the engaged body 62, a right upper part is notched and a V-shaped convex piece 92 is formed at a right lower part. In addition, a first leading path 94 inclined upward for leading the pin 72 is formed at a central upper part. In addition, a stepped part 96 having a cut upper surface is formed from almost the central part to a left central part and from a lower end of the first leading path 94 to a central upper part. In this stepped part 96, the left vicinity of the first leading path 94 is an engagement stepped part 96*d* which engages with the pin 72. An engagement cancel guiding path 96*a* which is a wall surface of the stepped part 96 is formed so as to be inclined downward to the left, from the left vicinity of the first leading path 94 to the left end, and when the engaged body 62 is moved toward the engaging body mounting member 59, the pin 72 abuts on the engagement cancel guiding path 96*a* so that the pin 72 is slid downward in the case 68. A left surface of the V-shaped piece 92 is a second leading path 92*b* on which the pin 72 abuts when the engaged body 62 is moved in the direction leaving the engaging body mounting member 59, which slides the pin 72 to the original position (upward) in the case 68.

Figure 10C:
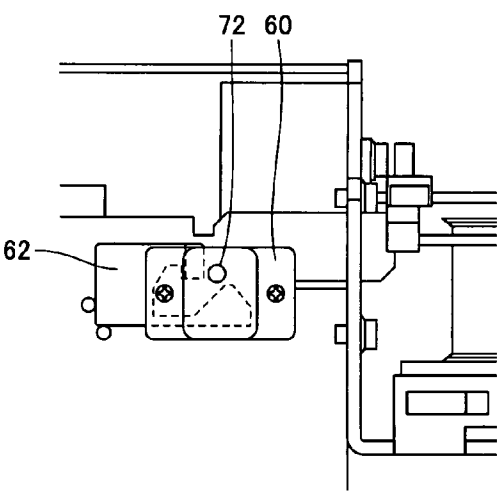
FIGS. 10A to 10C are views showing movement of the pin on the engaged body concretely.
Figure 10B:
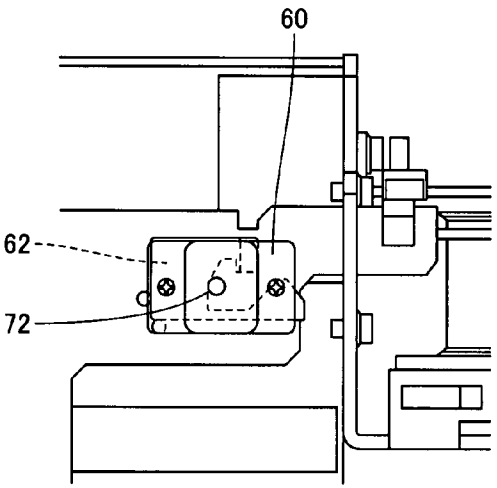
Figure 10A:
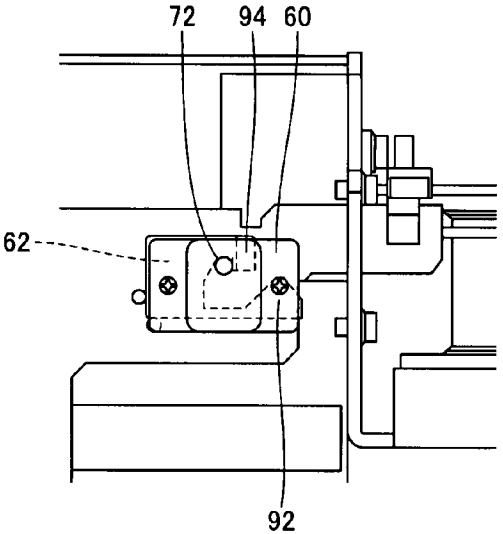

The engaged body 62 constituted as described above is mounted on the inkjet head mounting part 35 so that the convex part of the V-shaped piece 92 may face upward as shown in FIGS. 10A to 10C. FIGS. 10A to 10C are enlarged views of a part shown by X in FIG. 4C, which show a state the pin 72 of the engaging body engages with the engaged body 62.

Here, according to the engaged body 62, when the pin 72 of the engaging body 60 is positioned on the upper side (when the slider 74 is positioned on the upper side and the metal ball 70 engages with the upper groove 64*b* in FIG. 6), the pin 72 abuts on the first leading path 94 of the engaged body 62 and can engage with the engagement stepped part 96*d* in the left vicinity of the first leading path 94 as shown in FIG. 9, and when the pin 72 is positioned on the lower side (when the slider 74 is positioned on the lower side and the metal ball 70 engages with the lower groove 64*a* in FIG. 6), the pin 72 is positioned at a place in which it can be moved from the engagement cancel position 96*c* at an almost central left part until it abuts on the second leading path 92*b* on the right side.

A description is made of the movement of the above pin 72 together with the movement of the inkjet head carriage 42. The inkjet head carriage 42 is moved in the right direction by moving the cutting head carriage 49 as shown in FIG. 2A when the inkjet head carriage 42 is connected to the engaging body mounting member 59 provided at the end. At this time, when the pin 72 of the engaging body 60 is at the lower position, the pin 72 is guided by a right side surface 92*a* of the V-shaped piece of the engaged body 62 so as to be slid upward and then the pin 72 abuts on the first leading path 94 of the engaged body 62. Alternatively, when the pin 72 of the engaging body 60 is at the upper position, the pin 72 abuts on the first leading path 94 without abutting on the right side surface 92*a* of the V-shaped piece of the engaged body 62. As the inkjet head carriage 42 is further moved to the right, the pin 72 climbs up the first leading path 94 and engages with the engagement stepped part 96*d*. Here, connection between the inkjet head carriage 42 and the engaging body mounting member 59 is completed. This state is shown in FIG. 10A. At this time, the nozzles of the inkjet head 40 is locked in a capped state by the capping device 37.

As the cutting head carriage 49 is moved to the left in this state, since the movement of the pin 72 is limited by the engagement wall surface 96*d* of the stepped part 96 existing in the right vicinity of the first leading path 94, the inkjet head carriage 42 cannot be separated from the engaging body mounting member 59. Therefore, the cutting head carriage 49 and the inkjet head carriage 42 can be separated from each other in this state.

When both are separated by canceling the locked state between the engaged body 62 provided in the inkjet head carriage 42 and the engaging body 60 provided in the engaging body mounting member 59 provided at the end, the inkjet head carriage 42 is moved to the right by the cutting head carriage 49. At this time, the pin 72 of the engaging body 60 is guided to the engagement cancel guiding path 96*a* shown in FIG. 9 to be slid to the engagement cancel position 96*c*. This state is shown in FIG. 10B. Then, when the inkjet head carriage 42 is moved to the left, the pin 72 abuts on the second leading path 92*b* which is the left side surface of the V-shaped piece. Then, the pin 72 is guided by the second leading path 92*b* to be slid to a connection cancel position 92*c*, that is, the position before it comes into contact with the first leading path 94. Here, the separation between the inkjet head carriage 42 and the engaging body mounting member 59 is completed. This state is shown in FIG. 10C.

In addition, according to this embodiment, since the movement of the inkjet head carriage 42 and the cutting head carriage 49 is controlled by one driving device, error caused by precision of movement distance of the inkjet head carriage 42 and the cutting head carriage 49, error caused by backlash owing to repetitive movement and deviation between an image and its cutting line owing to error in parallelism and so on are avoided and adjustment management can be unnecessary.

Figure 11:
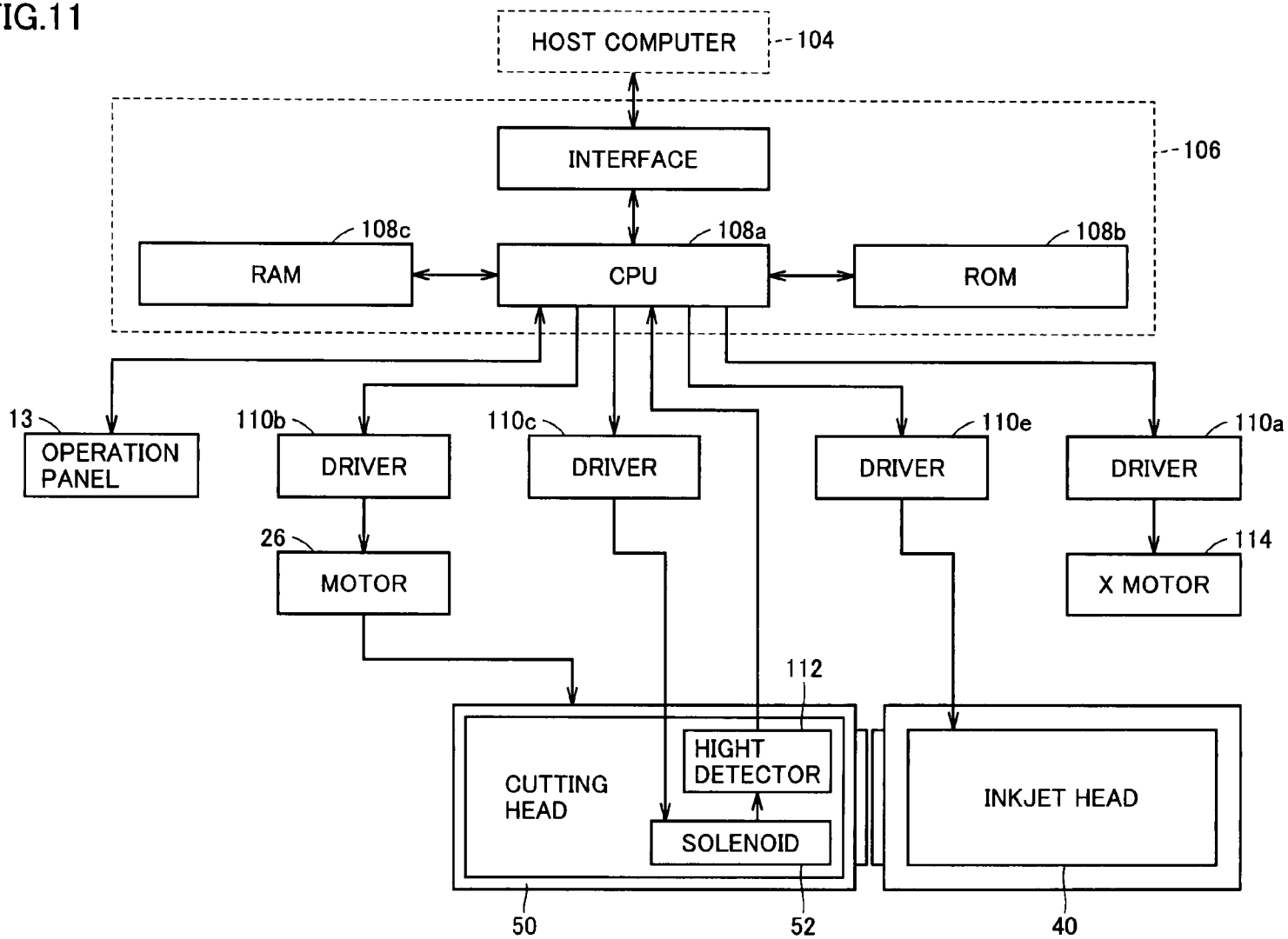
FIG. 11 is a block diagram showing a controller of the inkjet printer with the cutting head.

Next, a description is made of an operation of the inkjet printer 10 with the cutting head. FIG. 11 is a block diagram showing an essential part of a controller of the inkjet printer with the cutting head. Referring to FIG. 11, a description is made of one embodiment of a method of controlling printing and cutting operations of an image by the inkjet printer 10 with cutting head.

A sheet conveyance roller (not shown) of the inkjet printer with the cutting head is moved by an X motor 114, a sheet (not shown) on the platen 20 is moved in the X direction along its upper surface and the cutting head carriage 49 is moved by the motor 26 in the Y direction along the linear motion rail 31.

A whole operation of the inkjet printer 10 with the cutting head is controlled by a signal of image data output from a microcomputer in response to a data signal from an outside host computer 104 such as a personal computer.

Therefore, when a desired image is formed on the sheet (not shown), the magnet 44 and the magnet 45 are attached and the cutting head carriage 49 and the inkjet head carriage 42 are connected so that the inkjet head carriage 42 can be moved together with the cutting head carriage 49.

When an outline or the like of the image formed by the inkjet head 40 is cut out, the magnet 44 and the magnet 45 are separated, the inkjet head carriage 42 is separated from the cutting head carriage 49 and the inkjet head carriage 42 is fixed to the end of the inkjet printer 10 with the cutting head by engaging the engaged body 62 mounted on the inkjet head mounting part 35 with the engaging body 60 mounted on the engaging body mounting member 59 so that only the cutting head carriage 49 can be moved and controlled.

A microcomputer 106 comprises a CPU 108*a*, a read only memory (ROM) 108*b* storing a program the CPU 108*a* carries out, and a random access memory (RAM) 108*c* serving as a working area in which buffer memory for temporally storing a data signal from the host computer 104, various kinds of registers needed when the CPU 108*a* executes the program and the like are set.

Drivers 110*a*, 110*b* and 110*c* for performing on/off control of the X motor 114, a motor 26 and a solenoid 52, respectively, a driver 110*e* for controlling the inkjet head 40 and the operation panel 13 in which a switch turning on/off a power supply or various kinds of operation keys are provided are connected to the CPU 108*a* through buses.

In addition, although it is preferable that stepping motors are used as the X motor 114, the motor 26 and the solenoid 52 in the embodiment of the controlling method, servomotors can be also used. In this case, an encoder and a height detector 112 are connected to the X motor 114, the motor 26 and the solenoid 52 so that the states of the X motor 114, the motor 26 and the solenoid 52 can be always detected, and RAM 108*c* stores data of the position of the inkjet head 40 to the sheet through the CPU 108*a* so that it can be always read. Such encoder and the height detector 112 can always detect the states of the X motor 114, the motor 26 and the solenoid 52 regardless of the on/off states of the X motor 114, the motor 26 and the solenoid 52.

When a desired image is formed on the sheet in the state in which the magnet 44 and the magnet 45 are attached and the inkjet head 40 is connected to the cutting head 50 in the above constitution, the signal of the image data output from the host computer 104 is read and stored in the buffer memory of the RAM 108*c*.

Then, the CPU 108*a* sequentially reads the image data in the RAM 108*c* and drives the X motor 114, the motor 26 and the solenoid 52 by controlling the drivers 110*a*, 110*b*, 110*c*, and 110*e* according to the read image data. Thus, the inkjet nozzle 41 set in the inkjet head 40 is selected and the desired image is formed on the surface of the sheet by the selected inkjet nozzle 41.

Figure 12:
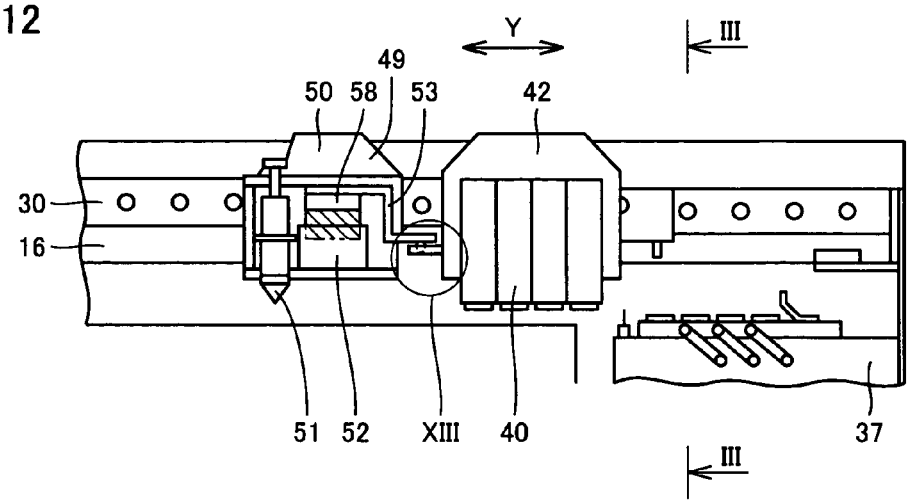
FIGS. 12 and 13 are views showing another embodiment of a connection method between the cutting head carriage and the inkjet head carriage.
Figure 13:
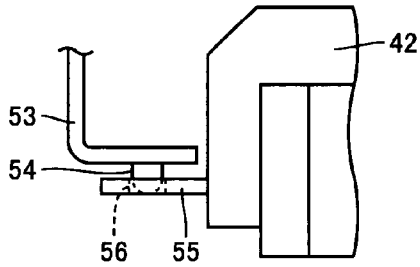

Then, a description is made of another embodiment of a connection part between the inkjet head carriage 42 and the cutting head carriage 49. FIGS. 12 and 13 are views showing another connection state between the inkjet head carriage 42 and the cutting head carriage 49, and FIG. 12 corresponds to FIG. 2. FIG. 13 is a detailed view of a part shown by XIII in FIG. 12.

According to this embodiment, the inkjet head carriage 42 and the cutting head carriage 49 are connected by the solenoid 52 for moving the cutter provided in the cutting head carriage 49 up and down, instead of the magnets.

Referring to FIG. 13, a description is made of the connection part between the inkjet head carriage 42 and the cutting head carriage 49. A connecting member 53 connected to the plunger of the solenoid 52 of the cutting head 50 is extended from the cutting head carriage 49. A projection 54 is provided downward at the end of the connecting member 53. The connecting member 53 is moved up and down by the solenoid 52. Meanwhile, a link part 55 is provided at the end of the inkjet head carriage 42 on the side of the cutting head. A hole 56 is provided in the link part 55 and the projection 54 of the connecting member 53 engages with the hole 56 when the solenoid 52 is operated. FIG. 13 shows an engagement state.

As described above, according to this embodiment, the solenoid 52 is used for moving the connecting member 53 up and down and for moving cutter 51 up and down.

Although the embodiments of the present invention are described with reference to the drawings, the present invention is not limited to the illustrated embodiments. Various kinds of modifications and variations can be added to the above illustrated embodiments within the same or equivalent scope with the present invention.

What is claimed is:

1. An inkjet printer with a cutting head for forming a desired image and cutting the image based on image data comprising:

moving means for moving a sheet in the X direction;

a linear motion guide comprising a guide rail and a linear motion block, wherein a plurality of balls are provided between the guide rail and the linear motion block;

a cutting head supported so as to be movable in the Y direction along said linear motion guide on the guide rail provided so as to be extended in the Y direction perpendicular to the X direction in which the sheet is moved by said moving means and comprising a cutter for cutting said sheet based on the desired image;

an inkjet head supported so as to be movable in the Y direction along said linear motion guide, provided so as to be positioned on the side of said cutting head in the Y direction, and forming the desired image on said sheet;

controlling means for controlling the movement of said cutting head and said inkjet head in the Y direction along said linear motion guide based on the image data;

first connecting means provided in said cutting head on the side of said inkjet head in the Y direction so as to be connected to a second connecting means, for detachably connecting said inkjet head to said cutting head, wherein said cutting head comprises a solenoid for driving said cutter and said solenoid operates as said first connection means;

said second connecting means provided in said inkjet head on the side of said cutting head in the Y direction so as to be connected to said first connecting means, for detachably connecting said cutting head to said inkjet head; and an engaging body provided in said inkjet head on the opposite side of said cutting head in the Y direction, for detachably locking the inkjet head to an engaged body of said inkjet printer, wherein when the image is formed based on said image data, said inkjet head is separated from the engaged body of said inkjet printer by said engaging body, said first connecting means and the second connecting means are connected to connect said cutting head and said inkjet head, and said inkjet head and said cutting head are integrally moved along said linear motion guide in the Y direction by said controlling means, based on said image data to form the desired image on said sheet, and when the image is cut based on said image data, said inkjet head is locked to the engaged body of said inkjet printer by said engaging body, said first connecting means is separated from said second connecting means to separate said inkjet head from said cutting head, and only said cutting head is moved along said linear motion guide in the Y direction by said controlling means, based on said image data to cut the said sheet based on said desired image.

2. The inkjet printer with the cutting head according to claim 1, wherein both or any one of said first connecting means and said second connecting means comprises a magnet.

3. The inkjet printer with the cutting head according to claim 2, wherein said magnet connection is separated by moving said cutting head in the direction opposite to said engaged body in a state said inkjet head is locked to said engaged body by the engaging body and the inkjet head and the cutting head are connected by said magnet.

4. The inkjet printer with the cutting head according to claim 1, wherein said first connecting means and said second connecting means comprise a solenoid with a plunger and an engagement hole, respectively.

5. The inkjet printer with the cutting head according to claim 1, comprising an engaging body mounting member having a member for positioning a nozzle of said inkjet head at a capping position provided at one end of said guide rail, wherein said engaging body mounting member is constituted by a single member.

6. An inkjet printer with a cutting head for forming a desired image and cutting the image based on image data comprising:

moving means for moving a sheet in the X direction;

a linear motion guide comprising a guide rail and a linear motion block, wherein a plurality of balls are provided between the guide rail and the linear motion block;

a cutting head supported so as to be movable in the Y direction along said linear motion guide on the guide rail provided so as to be extended in the Y direction perpendicular to the X direction in which the sheet is moved by said moving means and comprising a cutter for cutting said sheet based on the desired image;

an inkjet head supported so as to be movable in the Y direction along said linear motion guide, provided so as to be positioned on the side of said cutting head in the Y direction, and forming the desired image on said sheet;

controlling means for controlling the movement of said cutting head and said inkjet head in the Y direction along said linear motion guide based on the image data;

first connecting means provided in said cutting head on the side of said inkjet head in the Y direction so as to be connected to a second connecting means, for detachably connecting said inkjet head to said cutting head wherein said engaging body is unlocked from a state in which the engaging body of said inkjet head engages with the engaged body by moving said cutting head and said inkjet head in the direction to said engaged body.

7. An inkjet printing apparatus comprising:

moving means for moving a sheet in a first direction;

a cutting head movable in a second direction along a linear motion guide on a guide rail as to be extended in the second direction, wherein the cutting head comprises a cutter for cutting the sheet based on a desired image;

an inkjet head movable in the second direction along the linear motion guide, the inkjet head being positioned on the side of the cutting head in the second direction, and being configured to form the desired image on the sheet;

controlling means for controlling the movement of the cutting head and the inkjet head in the second direction along the linear motion guide based on image data;

first connecting means, provided in the cutting head on the side of the inkjet head in the second direction, for detachably connecting the inkjet head to the cutting head;

second connecting means, provided in the inkjet head on the side of the cutting head in the second direction and connected to the first connecting means, for detachably connecting the cutting head to the inkjet head; and an engaging body provided in the inkjet head on the opposite side of the cutting head in the second direction, for detachably locking the inkjet head to an engaged body, wherein when the image is formed based on the image data, the inkjet head is separated from the engaged body by the engaging body, the first connecting means and the second connecting means connecting the cutting head and the inkjet head, and the inkjet head and the cutting head are integrally moved along the linear motion guide in the second direction by the controlling means, based on the image data to form the desired image on the sheet, and when the image is cut based on the image data, the inkjet head is locked to the engaged body by the engaging body, the first connecting means is separated from the second connecting means to separate the inkjet head from the cutting head, and only the cutting head is moved along the linear motion guide in the second direction by the controlling means, based on the image data to cut the sheet based on the desired image, wherein the cutting head comprises a solenoid for driving the cutter, and the solenoid operates as the first connection means.

8. An inkjet printing apparatus comprising:

moving means for moving a sheet in a first direction;

a cutting head movable in a second direction along a linear motion guide on a guide rail as to be extended in the second direction, wherein the cutting head comprises a cutter for cutting the sheet based on a desired image;

an inkjet head movable in the second direction along the linear motion guide, the inkjet head being positioned on the side of the cutting head in the second direction, and being configured to form the desired image on the sheet;

controlling means for controlling the movement of the cutting head and the inkjet head in the second direction along the linear motion guide based on image data;

first connecting means, provided in the cutting head on the side of the inkjet head in the second direction, for detachably connecting the inkjet head to the cutting head;

second connecting means, provided in the inkjet head on the side of the cutting head in the second direction and connected to the first connecting means, for detachably connecting the cutting head to the inkjet head; and an engaging body provided in the inkjet head on the opposite side of the cutting head in the second direction, for detachably locking the inkjet head to an engaged body, wherein when the image is formed based on the image data, the inkjet head is separated from the engaged body by the engaging body, the first connecting means and the second connecting means connecting the cutting head and the inkjet head, and the inkjet head and the cutting head are integrally moved along the linear motion guide in the second direction by the controlling means, based on the image data to form the desired image on the sheet, and when the image is cut based on the image data, the inkjet head is locked to the engaged body by the engaging body, the first connecting means is separated from the second connecting means to separate the inkjet head from the cutting head, and only the cutting head is moved along the linear motion guide in the second direction by the controlling means, based on the image data to cut the sheet based on the desired image, wherein the engaging body is unlocked from a state in which the engaging body of the inkjet head engages with the engaged body by moving the cutting head and the inkjet head in the direction to the engaged body.

* * * * *